US008342882B2

(12) United States Patent
Zhang et al.

(10) Patent No.: US 8,342,882 B2
(45) Date of Patent: Jan. 1, 2013

(54) USB INTERFACE DEVICE AND TERMINAL DEVICE

(75) Inventors: Xialing Zhang, Shenzhen (CN); Chunshu Li, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 13/338,715

(22) Filed: Dec. 28, 2011

(65) Prior Publication Data

US 2012/0100755 A1 Apr. 26, 2012

Related U.S. Application Data

(63) Continuation of application No. PCT/CN2010/074296, filed on Jun. 23, 2010.

(51) Int. Cl.
*H01R 13/648* (2006.01)

(52) U.S. Cl. ..... 439/607.35

(58) Field of Classification Search ..... 439/607.35, 439/607.34, 607.4, 607.32, 607.33, 76.1, 439/910, 607.31
See application file for complete search history.

(56) References Cited

U.S. PATENT DOCUMENTS

| | | | | |
|---|---|---|---|---|
| 6,053,773 | A | 4/2000 | Wu | |
| 6,155,872 | A | 12/2000 | Wu | |
| 6,183,292 | B1 * | 2/2001 | Chen et al. | 439/541.5 |
| 6,211,457 | B1 | 4/2001 | Cama et al. | |
| 6,398,587 | B1 | 6/2002 | Chen et al. | |
| 7,275,940 | B2 * | 10/2007 | Chen et al. | 439/79 |
| 2003/0232541 | A1 | 12/2003 | Meister | |
| 2004/0192075 | A1 | 9/2004 | Lu | |

FOREIGN PATENT DOCUMENTS

| | | | |
|---|---|---|---|
| CN | 2360998 | Y | 1/2000 |
| CN | 2699512 | Y | 5/2005 |
| JP | 2003-229214 | A | 8/2003 |

OTHER PUBLICATIONS

International Search Report, PCT/CN2010/074296, dated Oct. 8, 2010, 4 pages.
Supplementary European Search Report received in European Application No. 10807928.6, dated Jul. 24, 2012, 7 pages.

* cited by examiner

*Primary Examiner* — Phuong Dinh
(74) *Attorney, Agent, or Firm* — Slater and Matsil, LLP

(57) ABSTRACT

A USB interface device includes a USB connector electrically connected with a circuit board through pins. A shielding frame is attached to a joint between the USB connector and the circuit board and covering the pins. The shielding frame is a frame body having a first opening at a part thereof attached to the circuit board and a second opening at a part thereof attached to the USB connector.

14 Claims, 3 Drawing Sheets

USB INTERFACE DEVICE AND TERMINAL DEVICE

This application is a continuation of International Application No. PCT/CN2010/074296, filed on Jun. 23, 2010, which claims priority to Chinese Patent Application No. 200920171219.2, filed on Aug. 12, 2009, both of which are hereby incorporated by reference in their entireties.

TECHNICAL FIELD

The present invention relates to the field of electromagnetic interference technologies, and in particular, to a USB interface device and a terminal device that can resist electromagnetic interference.

BACKGROUND

With the development of USB (Universal Serial Bus, Universal Serial Bus) interface standards, the transmission rate is improving. The transmission rate of the USB2.0 standard has reached 480 MB/s (Megabits per second). The upcoming USB3.0 standard will provide higher transmission rate. Currently, USB interfaces have been applied widely for transmitting data. A data card is connected to a computer through a USB interface. As shown in FIG. 1, pins 2 of a conventional USB connector 1 are welded on a bonding pad of a PCB (Printed Circuit Board) 3 directly. Four pins 2 (including two power supply pins and two data pins) on the USB connector 1 are exposed outside the PCB (Printed Circuit Board) 3. Data needs to be transmitted at a high rate on the USB connector 1, so the high-rate data transmission generates electromagnetic radiation.

The inventor finds that at least the following problems exist in the prior art. In the case that a data card (namely, a wireless modem) is also connected to the computer through a USB interface, the electromagnetic radiation generated by the USB interface generates Electro Magnetic Interference (EMI, Electro Magnetic Interference) to the data card, and deteriorates radio performance of the data card and impairs the radio performance of the whole system directly. Moreover, higher transmission rate of the USB interface leads to more EMI. Therefore, the upcoming USB3.0 standards will provide higher transmission rate and lead to grimmer EMI.

SUMMARY OF THE INVENTION

Embodiments of the present invention provide a USB interface device and a terminal device to resist EMI generated by a USB connector in a data transmission process.

The foregoing objectives are fulfilled through the following technical solutions: A USB interface device includes a USB connector electrically connected with a circuit board through pins. The device also includes a shielding frame attached to a joint between the USB connector and the circuit board and covering the pins. The shielding frame is a frame body having a first opening at a part attached to the circuit board and a second opening at a part attached to the USB connector.

The access module is configured to enable the terminal device to access a network in a wireless mode.

Through the USB interface device and the terminal device provided in the embodiments of the present invention, a shielding frame that covers the pins is set at the joint between the USB connector and the PCB. The pins at the USB connector generate electromagnetic radiation when the USB interface transmits data at a high rate, and the shielding frame may shield the electromagnetic radiation, so that the electromagnetic radiation generate at the pins of the USB connector will not generate the EMI in the wireless communication. If this solution is applied to a device requiring wireless communication such as a data card with a USB interface, the EMI is resisted and the performance of the whole system is improved. Even if the transmission rate of the USB interface improves, the high transmission rate causes no EMI to the wireless communication, which makes preparations for the improvement of the transmission rate of the USB interface.

BRIEF DESCRIPTION OF THE DRAWINGS

To illustrate the technical solution under the present invention or the prior art more clearly, the following outlines the accompanying drawings involved in description of the embodiments of the present invention or the prior art. Apparently, the accompanying drawings outlined below are illustrative rather than exhaustive. Persons of ordinary skill in the art can derive other drawings from such accompanying drawings without any creative effort.

DETAILED DESCRIPTION OF ILLUSTRATIVE EMBODIMENTS

The following detailed description is given in conjunction with the accompanying drawings to provide a thorough understanding of the present invention. Evidently, the drawings and the detailed description are merely representative of particular embodiments of the present invention rather than all embodiments. All other embodiments, which can be derived by those skilled in the art from the embodiments given herein without any creative effort, shall fall within the scope of the present invention.

Figure 1:
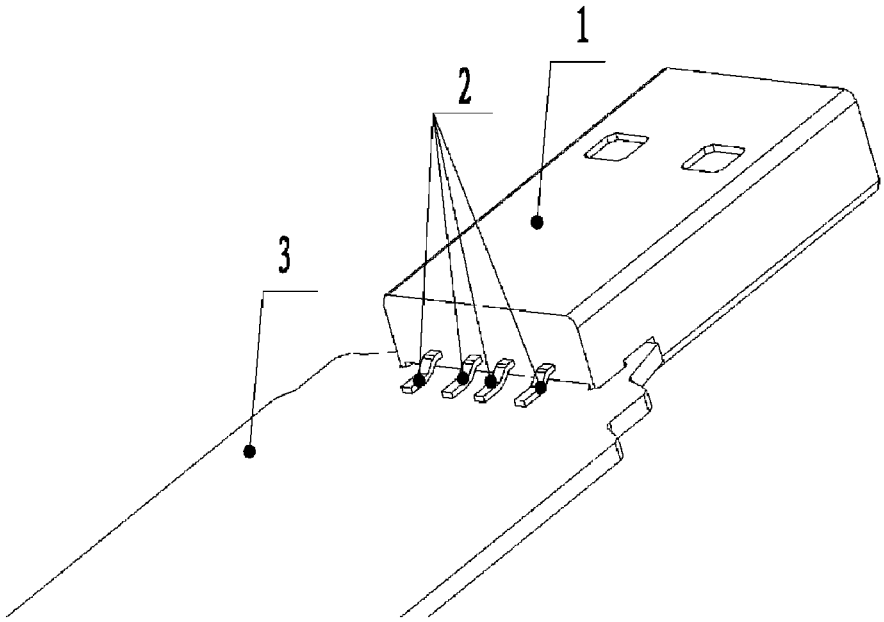
FIG. 1 is a structure diagram of a joint between a USB connector and a PCB in the prior art.
Figure 2:
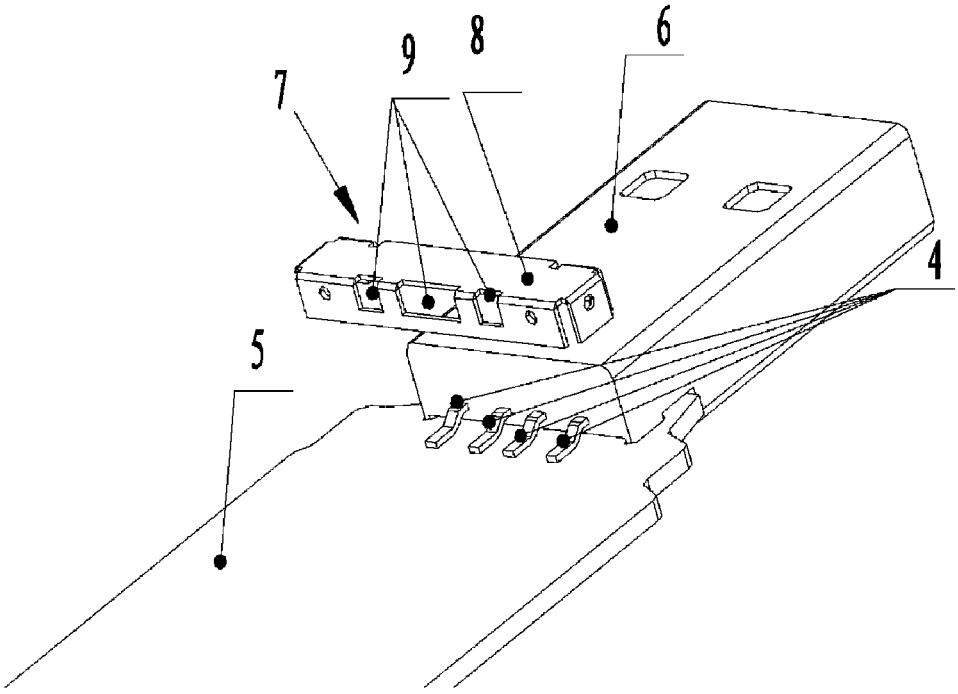
FIG. 2 is a structure diagram of a shielding frame according to an embodiment of the present invention.

As shown in FIG. 2, the USB interface device includes a USB connector 6 electrically connected with a PCB 5 through pins 4. The pins 4 include two power supply pins and two data pins, and can be welded onto the PCB 5. The USB interface device further includes a shielding frame 7 attached to a joint between the USB connector 6 and the PCB 5 and covering the pins 4. The pins 4 at the USB connector 6 generate electromagnetic radiation when the USB interface transmits data at a high rate, and the shielding frame shields the electromagnetic radiation, so that the electromagnetic radiation generate at the pins 4 of the USB connector 6 will not generate the EMI in the wireless communication. Even if the transmission rate of the USB interface improves, the high transmission rate causes no EMI to the wireless communication, which makes preparations for the improvement of the transmission rate of the USB interface. The USB interface may be a male USB interface of type A.

As shown in FIG. 2, the shielding frame 7 is generally a hexahedral frame body 8. Two faces of the hexahedral frame body 8 need to be attached to the PCB 5 and the USB connector 6 respectively, the face of the frame body 8 attached to the PCB 5 is set as an opening completely or partially, and the face of the frame body 8 attached to the PCB 6 is set as an opening completely or partially. The opening in the face of the frame body 8 attached to the PCB 5 is called a first opening, and the opening in the face of the frame body attached to the USB connector 6 is called a second opening. Definitely, the shielding frame 7 may be a frame body 8 other than a hexahedron. For example, the shielding frame 7 in FIG. 2 has a part neither attached to the PCB 5 nor attached to the USB connector 6, and this part is set as a curved face.

As shown in FIG. 2, an observation window 9 for observing the pins 4 may be set on the frame body 8 in order to check whether the pins 4 of the USB interface are welded reliably after completion of assembly.

Figure 3:
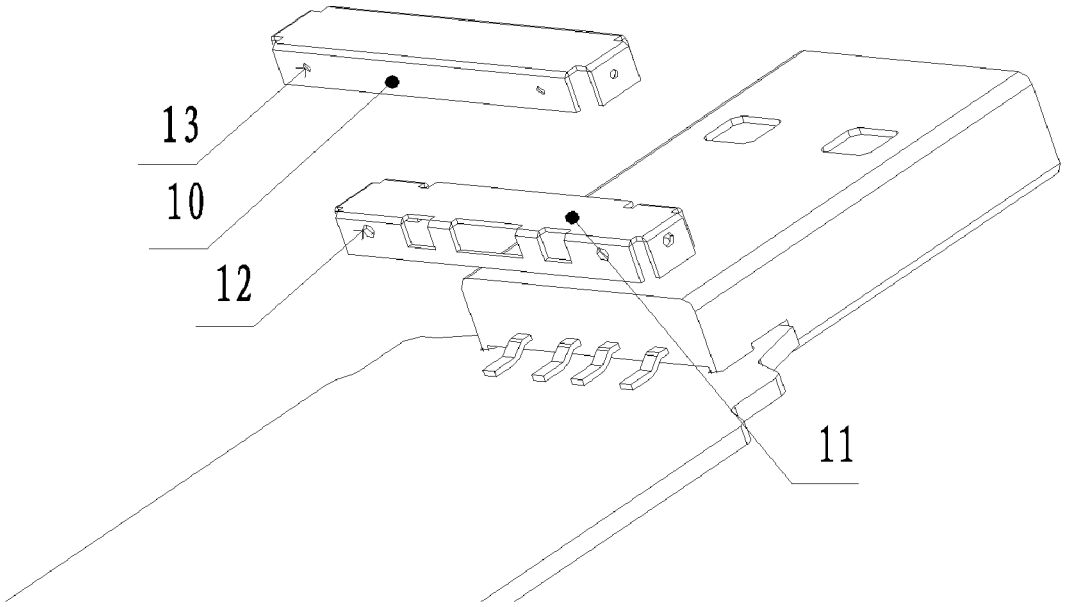
FIG. 3 is a structure diagram of a shielding frame and a shielding cover according to an embodiment of the present invention.

As shown in FIG. 3, the shielding frame 11 may also be covered with a shielding cover 10 to achieve better effect of resisting EMI in the embodiment of the present invention. The structure of the shielding frame 11 may be the same as the structure of the shielding frame 7 described in FIG. 2.

The shielding cover 10 in FIG. 3 is fastened to the shielding frame 11 to prevent displacement. The modes of fastening the shielding cover 10 to the shielding frame 11 include but are not limited to the following.

(1) As shown in FIG. 3, at least one spacing hole 12 is set in the shielding frame 11, and a spacing bump 13 corresponding to the spacing hole is set on the shielding cover 10. After the spacing bump 13 is clasped into the spacing hole 12, the shielding cover 10 is fixed to the shielding frame 11 reliably without any misalignment.

(2) At least one spacing bump (not shown) is set on the shielding frame 11, and a spacing hole corresponding to the spacing bump is set in the shielding cover 10. After the spacing bump is clasped into the spacing hole, the shielding cover is fixed to the shielding frame reliably without any misalignment.

No matter whether the spacing bump is set on the shielding frame or the shielding cover, the spacing bump can be stamped out. The stamping process generates a spacing bump quickly, which improves the production efficiency and reduces the production cost. Certainly, the shielding cover 10 may also be fixed to the shielding frame 11 through bolts and screws, by bonding, or by other means.

Figure 4:
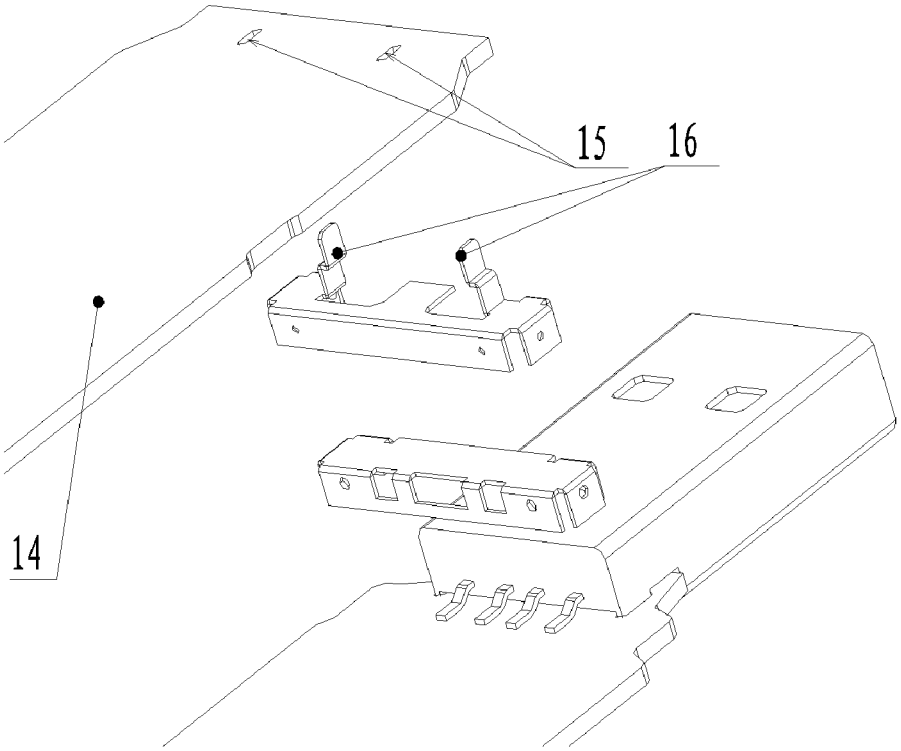
FIG. 4 is another structure diagram of a shielding cover according to an embodiment of the present invention.
Figure 5:
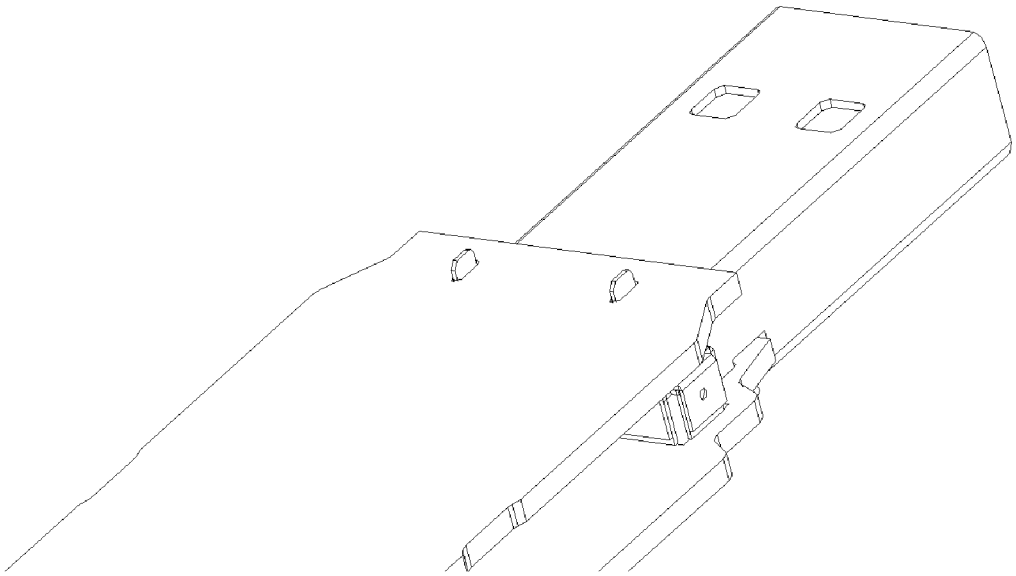
FIG. 5 is an effect diagram after completion of assembly according to an embodiment of the present invention.

Generally, the shielding mode shown in FIG. 2 or FIG. 3 makes the USB device competent for performing basic functions. In some scenarios, the USB device may have multiple PCBs, which requires improvement of the shielding solution. For example, as shown in FIG. 4, the USB interface device includes another PCB, that is, a second PCB 14. To fix the second PCB 14, a fixing hole 15 is set in the second PCB 14, and a fixing pin 16 corresponding to the fixing hole 15 is set on the shielding cover. The fixing pin 16 is inserted into the fixing hole 15 to fix the second PCB 14. Other parts of the shielding cover and the structure of the shielding frame can use the solution shown in FIG. 3. FIG. 5 is an effect diagram after all PCBs, the shielding frame, the shielding cover and the USB connector are assembled together.

A terminal device is further provided in an embodiment of the present invention, the terminal device is based on the technical solution of the USB interface device shown in FIG. 2 to FIG. 5. The terminal device further includes an access module (not shown), and the access module enables the terminal device to access the network in a wireless mode. For example, the access module is a WiFi access module, a 3G access module, or the like.

The terminal device may be a data card. The data card is connected with the USB interface of a computer through the USB interface device, and enables the computer to access the network through the data card in a wireless mode.

This embodiment of the present invention is mainly applicable to various devices with USB interfaces, especially, to wireless communication devices with USB interfaces. For example, the USB interface device provided in this embodiment of the invention is applicable to various terminal devices. The terminal devices may be fixed terminals or mobile terminals with USB interfaces, such as, a data card with a USB interface, a 3G data card, and a mobile phone. Besides, the antenna device is also applicable to various mobile devices and portable devices with USB interfaces, such as, an MP3 player, an MP4 player, a PSP (PlayStation Portable, PlayStation Portable), a digital camera, and a USB disk with a USB interface. The 3G data card refers to a device applied on a computer, where the device accesses the Internet through a $3^{rd}$ Generation (3G) mobile communication system.

The above descriptions are merely preferred embodiments of the present invention, but not intended to limit the scope of the present invention. Any modifications, variations or replacement that can be easily derived by those skilled in the art should fall within the scope of the present invention. Therefore, the protection scope of the present invention is subject to the appended claims.

What is claimed is:

1. A USB interface device, comprising:

a circuit board;

pins;

a USB connector electrically connected to the circuit board through the pins;

a shielding frame attached to a joint between the USB connector and the circuit board and covering the pins, wherein the shielding frame comprises a frame body having a first opening at a part attached to the circuit board and a second opening at a part attached to the USB connector; and a shielding cover that covers the shielding frame.

2. The USB interface device according to claim 1, further comprising an observation window for observing the pins, the observation window set on the frame body.

3. The USB interface device according to claim 1, wherein at least one spacing hole is set in the shielding frame, and a spacing bump corresponding to the spacing hole is set on the shielding cover.

4. The USB interface device according to claim 1, wherein at least one spacing bump is set on the shielding frame, and a spacing hole corresponding to the spacing bump is set in the shielding cover.

5. The USB interface device according to claim 3, wherein the spacing bump is generated through a stamping process.

6. The USB interface device according to claim 4, wherein the spacing bump is generated through a stamping process.

7. The USB interface device according to claim 1, further comprising a fixing pin set on the shielding cover, the fixing pin corresponding to a fixing hole in another circuit board, wherein the fixing pin is configured to be inserted into the fixing hole to fix the circuit board with the fixing hole.

8. The USB interface device according to claim 1, wherein the pins extend through the first opening to be connected with the circuit board, and the pins extend through the second opening to be connected with the USB connector.

9. The USB interface device according to claim 2, wherein the pins extend through the first opening to be connected with the circuit board, and the pins extend through the second opening to be connected with the USB connector.

10. A terminal device, comprising:

a USB interface device comprising a USB connector that is electrically connected with a circuit board through pins, the USB interface device further comprising a shielding frame attached to a joint between the USB connector and the circuit board and covering the pins and a shielding cover that covers the shielding frame, wherein the shielding frame comprises a frame body having a first opening at a part attached to the circuit board and a second opening at a part attached to the USB connector; and an access module coupled to the USB interface device and configured to enable the terminal device to access a network in a wireless mode.

11. The terminal device according to claim 10, wherein the USB interface device further comprises a fixing pin set on the shielding cover, the fixing pin corresponding to a fixing hole in another circuit board, wherein the fixing pin is configured to be inserted into the fixing hole to fix the circuit board with the fixing hole.

12. The terminal device according to claim 10, wherein the terminal device is a data card that is configured to be connected with a USB interface of a computer through the USB interface device, the terminal device enabling the computer to access the network through the data card in the wireless mode.

13. The terminal device according to claim 11, wherein the terminal device is a data card that is configured to be connected with a USB interface of a computer through the USB interface device, the terminal device enabling the computer to access the network through the data card in the wireless mode.

14. The terminal device according to claim 11, wherein the terminal device is a data card that is configured to be connected with a USB interface of a computer through the USB interface device, the terminal device enabling the computer to access the network through the data card in the wireless mode.

* * * * *